US010704239B2

(12) United States Patent
Abood

(10) Patent No.: US 10,704,239 B2
(45) Date of Patent: Jul. 7, 2020

(54) ADJUSTABLE SHOWER HEAD ASSEMBLY

(71) Applicant: Brian Richard Abood, Snohomish, WA (US)

(72) Inventor: Brian Richard Abood, Snohomish, WA (US)

( * ) Notice: Subject to any disclaimer, the term of this patent is extended or adjusted under 35 U.S.C. 154(b) by 71 days.

(21) Appl. No.: 15/992,086

(22) Filed: May 29, 2018

(65) Prior Publication Data

US 2019/0368175 A1 Dec. 5, 2019

(51) Int. Cl.

| | |
|---|---|
| ***E03C 1/06*** | (2006.01) |
| ***B05B 1/18*** | (2006.01) |
| ***E03C 1/04*** | (2006.01) |
| ***B65H 75/48*** | (2006.01) |
| ***B65H 75/44*** | (2006.01) |

(52) U.S. Cl.

CPC ..... *E03C 1/066* (2013.01); *B05B 1/185* (2013.01); *B65H 75/4428* (2013.01); *B65H 75/4478* (2013.01); *B65H 75/486* (2013.01); *E03C 1/0408* (2013.01); *B65H 2403/47* (2013.01); *B65H 2701/33* (2013.01); *Y10T 137/6969* (2015.04)

(58) Field of Classification Search

CPC ..... E03C 1/06; E03C 1/066; Y10T 137/6969; Y10T 137/6943

USPC ..... 4/615

See application file for complete search history.

(56) References Cited

U.S. PATENT DOCUMENTS

| | | | | |
|---|---|---|---|---|
| 1,556,765 | A | 10/1925 | Dechmann | |
| 2,697,839 | A | 12/1954 | Jackson | |
| 4,084,270 | A | 4/1978 | Kersten, Jr. | |
| 4,227,661 | A * | 10/1980 | King | A01G 25/095 137/355.27 |
| 4,543,982 | A * | 10/1985 | Wolfe | B65H 75/40 137/355.21 |
| 4,561,136 | A | 12/1985 | Baer | |
| 5,060,322 | A | 10/1991 | Delepine | |
| 5,381,981 | A * | 1/1995 | Nelson | B65H 75/14 137/355.27 |
| 5,768,721 | A | 6/1998 | Kersten | |
| 6,370,713 | B2 | 4/2002 | Bosio | |
| 7,082,627 | B2 | 8/2006 | Marrs et al. | |
| 7,707,664 | B1 * | 5/2010 | Flynn | E03C 1/06 4/570 |
| 8,978,175 | B2 | 3/2015 | Bronstein | |
| 2006/0207015 | A1 * | 9/2006 | DeBoer | B05B 1/205 4/615 |
| 2008/0185456 | A1 * | 8/2008 | McCabe | E03C 1/0408 239/197 |
| 2010/0043135 | A1 * | 2/2010 | Patterson | E03C 1/06 4/612 |
| 2017/0100000 | A1 | 4/2017 | Stanley | |

* cited by examiner

*Primary Examiner* — Kevin F Murphy

(74) *Attorney, Agent, or Firm* — Shlesinger, Arkwright & Garvey LLP

(57) ABSTRACT

A height adjustable shower head assembly comprising a receptacle adapted for mounting to a ceiling, a reel member provided in the housing, a flexible hose having first end and second ends, the flexible hose is stored on the reel and is adapted to be vertically deployed from the reel and retracted onto the reel, the first end of the flexible hose is connected to a water supply, the second end of the flexible hose is connected to a shower head, whereby the distance of the shower head from the ceiling may be adjusted by selectively deploying or retracting the flexible hose.

9 Claims, 5 Drawing Sheets

ADJUSTABLE SHOWER HEAD ASSEMBLY

FIELD OF THE INVENTION

This invention relates to a ceiling mounted shower head, and in particular, a ceiling mounted shower head that can be lowered to a desired height.

BACKGROUND OF THE INVENTION

A bathroom shower will include a shower head for directing water onto the user. One type is known as a rain shower head because it produces a spray that mimics rainfall. Unlike a conventional shower head where the water is forced out under high pressure, a rain shower head has a relatively large, flat surface and is disposed directly overhead of the user. This allows the water to gently exit the showerhead and fall by gravity onto the user in a manner similar to natural rainfall.

Although a rain shower head may be mounted to a wall using an articulated arm or other means for positional adjustment, a wall mounted rain shower head tends to be relatively small. Rain shower heads mounted to a ceiling are substantially larger, provide a wider cascade of water and are minimalist in design. In addition, a ceiling rain shower head is flush with the ceiling which is aesthetically pleasing.

A disadvantage of the ceiling mounted shower head is that its vertical height cannot be adjusted because it is fixed to the ceiling.

BRIEF SUMMARY OF THE INVENTION

A height adjustable shower head assembly comprising a receptacle adapted for mounting to a ceiling, a reel provided in the housing, a flexible hose having first end and second ends, the flexible hose is stored on the reel and is adapted to be vertically deployed from the reel and retracted onto the reel, the first end of the flexible hose is connected to a water supply, the second end of the flexible hose is connected to a shower head, whereby the distance of the shower head from the ceiling may be adjusted by selectively deploying or retracting the flexible hose.

DETAILED DESCRIPTION OF THE INVENTION

Figure 1:
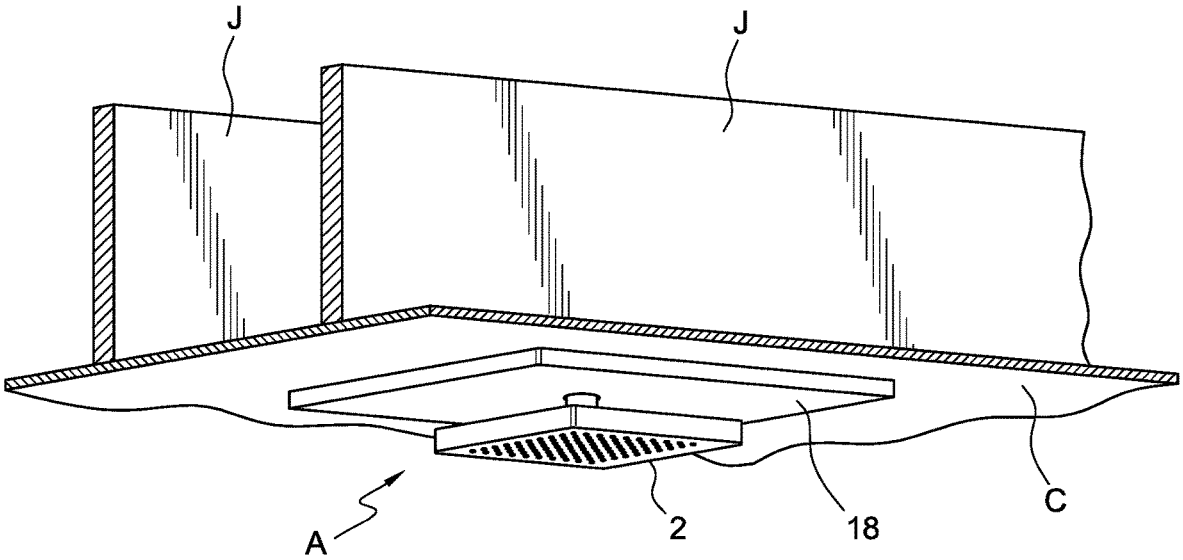
FIG. 1 is a perspective view showing the adjustable shower head assembly according to the present invention with portions of the ceiling to which it is secured being broken away.
Figure 2:
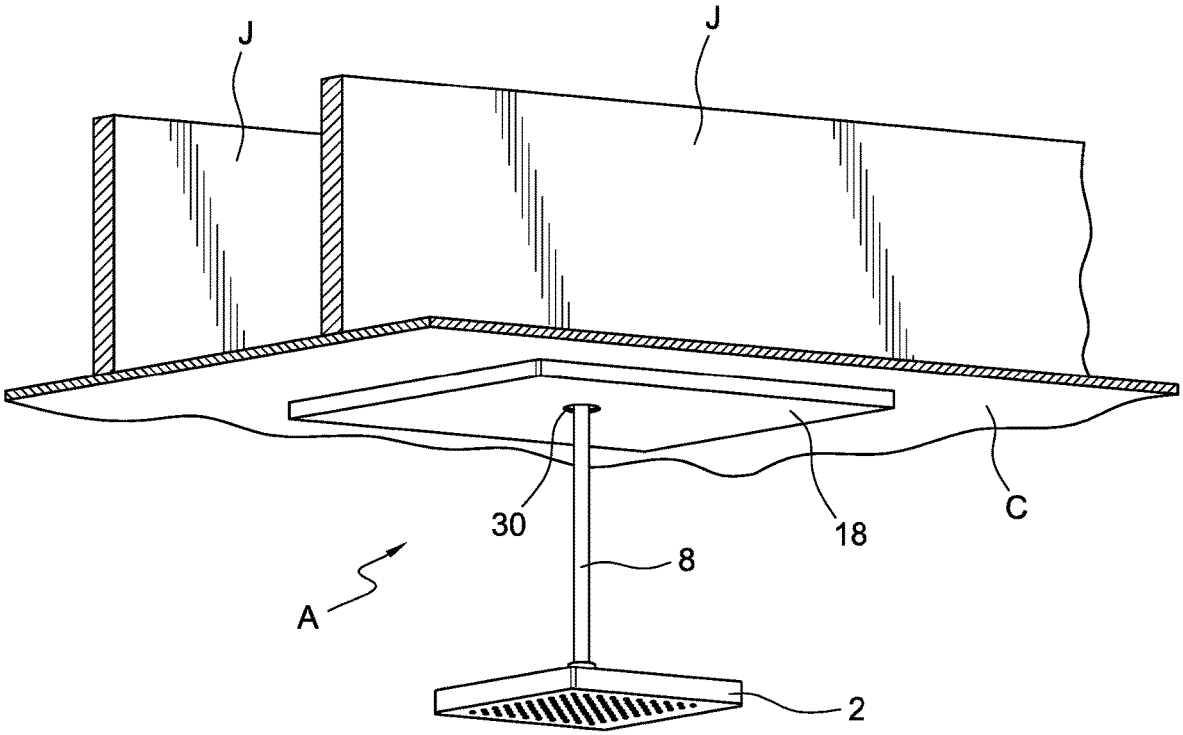
FIG. 2 is a perspective view showing the adjustable shower head assembly according to the present invention with the rain shower head shown deployed from the ceiling.

FIG. 1 shows the shower head assembly A according to the present invention when affixed to a shower room ceiling C and aligned between a pair of ceiling supports or joists J. FIG. 2 shows the assembly A shown in FIG. 1 with the shower head 2 disposed in a vertically lowered position with respect to the ceiling C.

Figure 3:
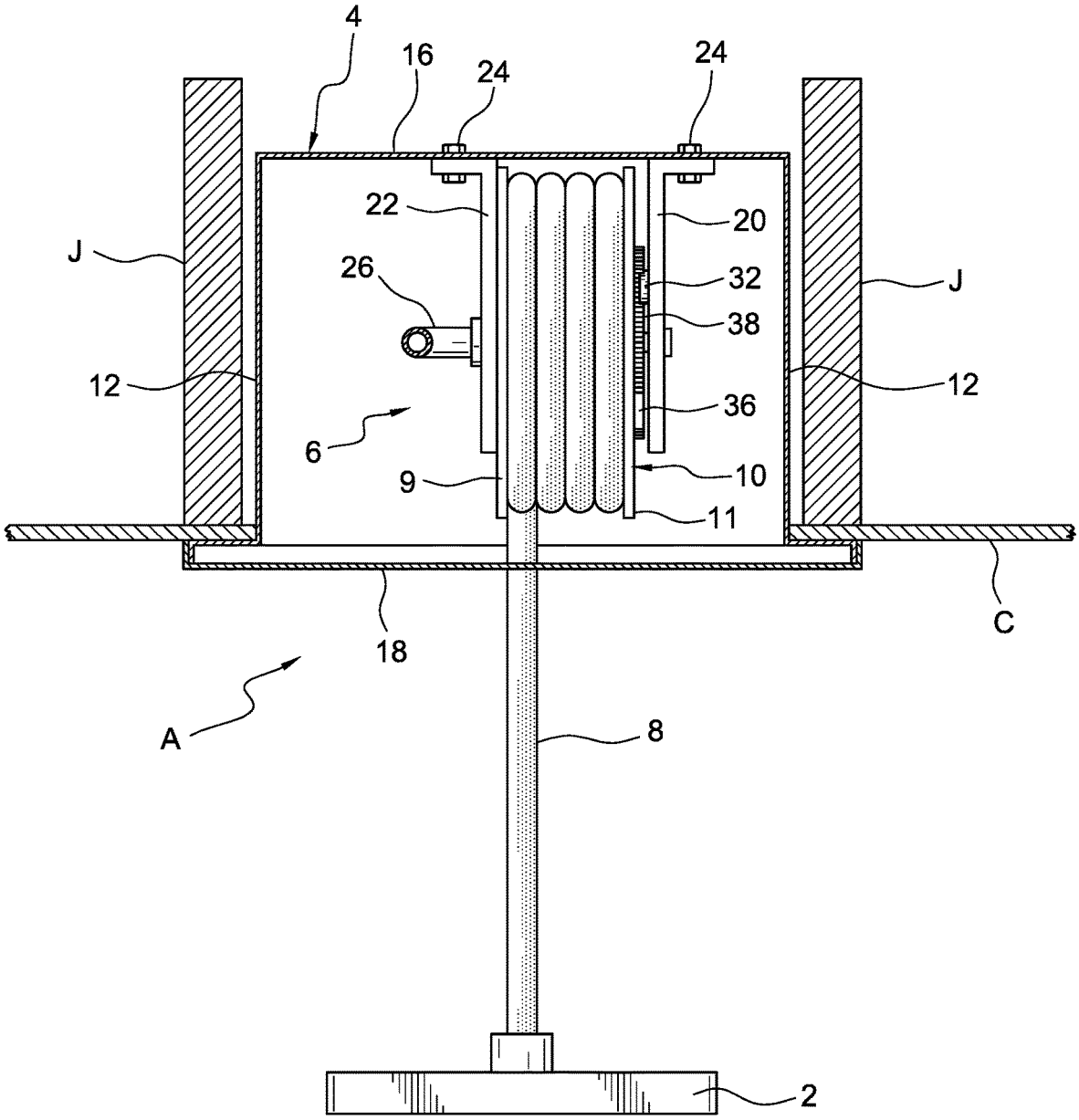
FIG. 3 is a front perspective of the assembly shown in FIG. 2 including the reel member within the housing.
Figure 4:
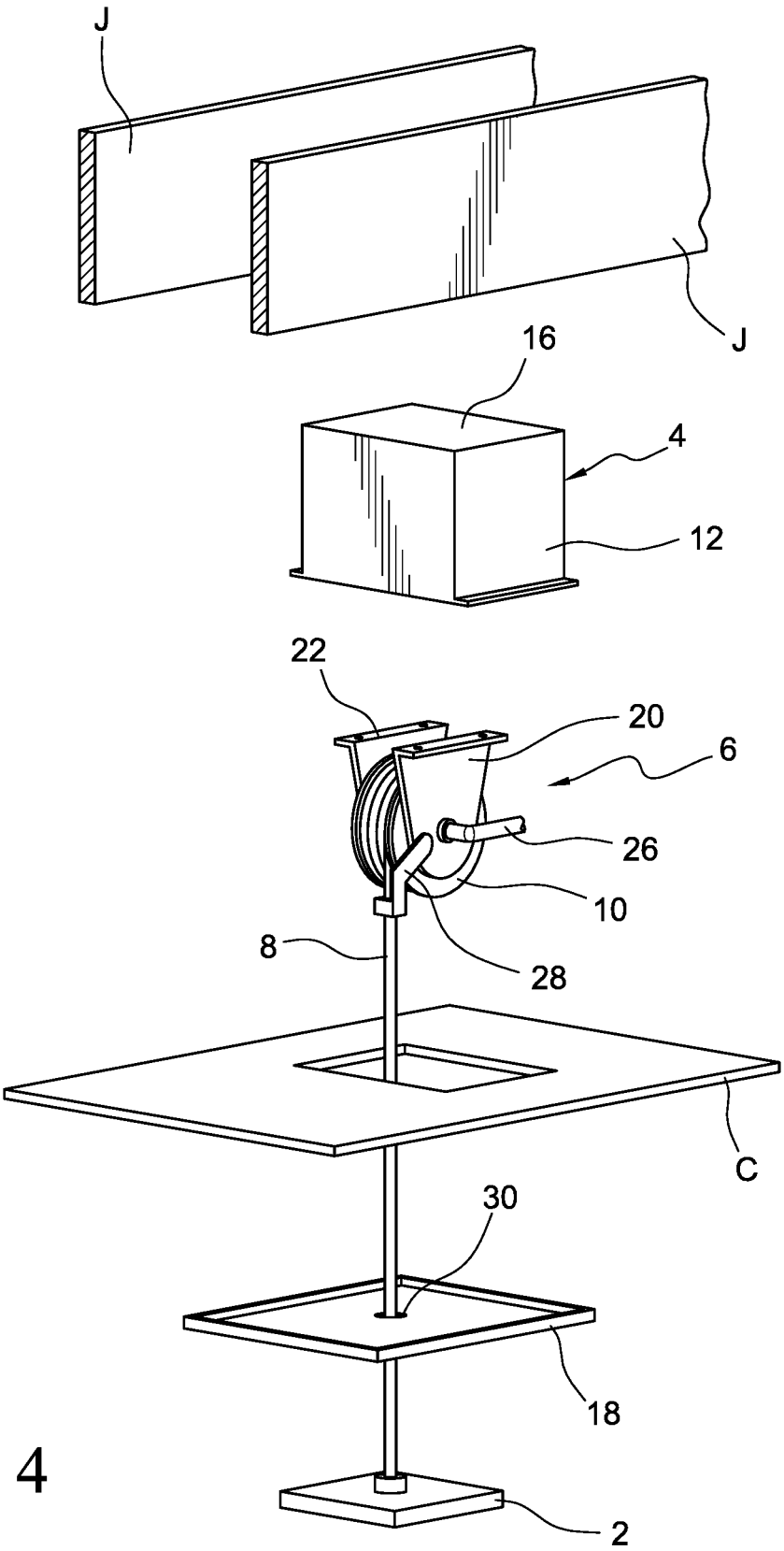
FIG. 4 is an exploded perspective view of the assembly shown in FIG. 3.

Turning to FIGS. 3 and 4, the shower head assembly A is shown in detail and can be seen to include a housing 4, having sides 12, a top 16 and a bottom 18. The housing contains a reel device 6 that is rotatable along a horizontal axis for purposes of storing and deploying a length of flexible hose 8. The reel device 6 includes a spool 10 rotatably mounted to the top 16 of the housing by a pair of mounting brackets 20, 22. The brackets 20, 22 are secured to the housing top 16 by fasteners 24 or other means. As is apparent other means for affixing the reel device 6 to the housing are within the scope of the present invention. For example, the axle of the reel device (not shown) may be extended to connect to the sides 12 of the housing. The housing 4 itself may be removed so that the axle of the reel connects to the joists J of the ceiling frame.

A rotary fitting 26 is provided on the reel device 6 for connecting to a water supply (not shown), the opposite end of which is connected to one end of the flexible hose 8. A hose guide 28, as best shown in FIG. 4, is secured to bracket 20 for purposes of guiding the hose 8 along a straight path as it passes through the opening 30 in the housing bottom 18 when the hose is being wound or unwound onto the reel device.

Figure 5:
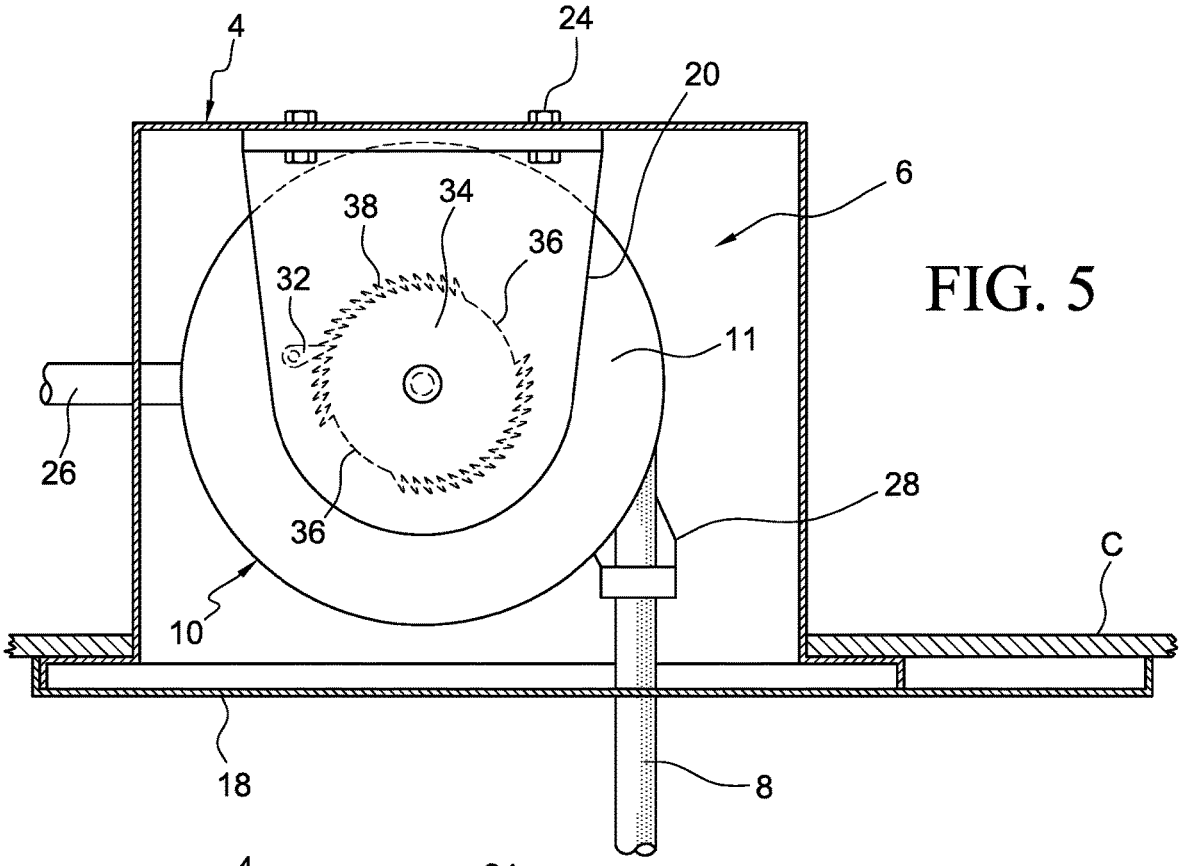
FIG. 5 is a cross-sectional side view of the housing shown in FIG. 2 including a first embodiment of the reel member.

Turning to FIGS. 3 and 5, a retractable ratchet 34 and pawl 32 mechanism is shown for enabling the spool 10 to be selectively rotated in opposite directions and deploy or retract the hose 8. The use of a ratchet and pawl permits rotation of the reel device 6 is a first direction but prevents counter rotation in an opposite direction. To render the ratchet and pawl retractable or otherwise enable it to rotate in two directions, the reel device 6 is loaded with a spring (not shown) to generate a rotational force in an opposite direction and gap regions 36 are provided on the ratchet wheel 34 to permit disengagement of the pawl from the ratchet wheel. The ratchet wheel 34 is fixed to a side 11 of the spool and the pawl 32 is fixed to the bracket 20.

In use, a user will pull downwardly on the hose 8 which causes the reel to unwind the hose 8 and prevent retraction in an opposite direction due to the pawl 32 being engaged with teeth 38. To reverse direction, the gap region 36 will permits disengagement of pawl 32 from teeth 38 and enable the reel to rotate in an opposite direction under the force of the spring load.

Figure 6:
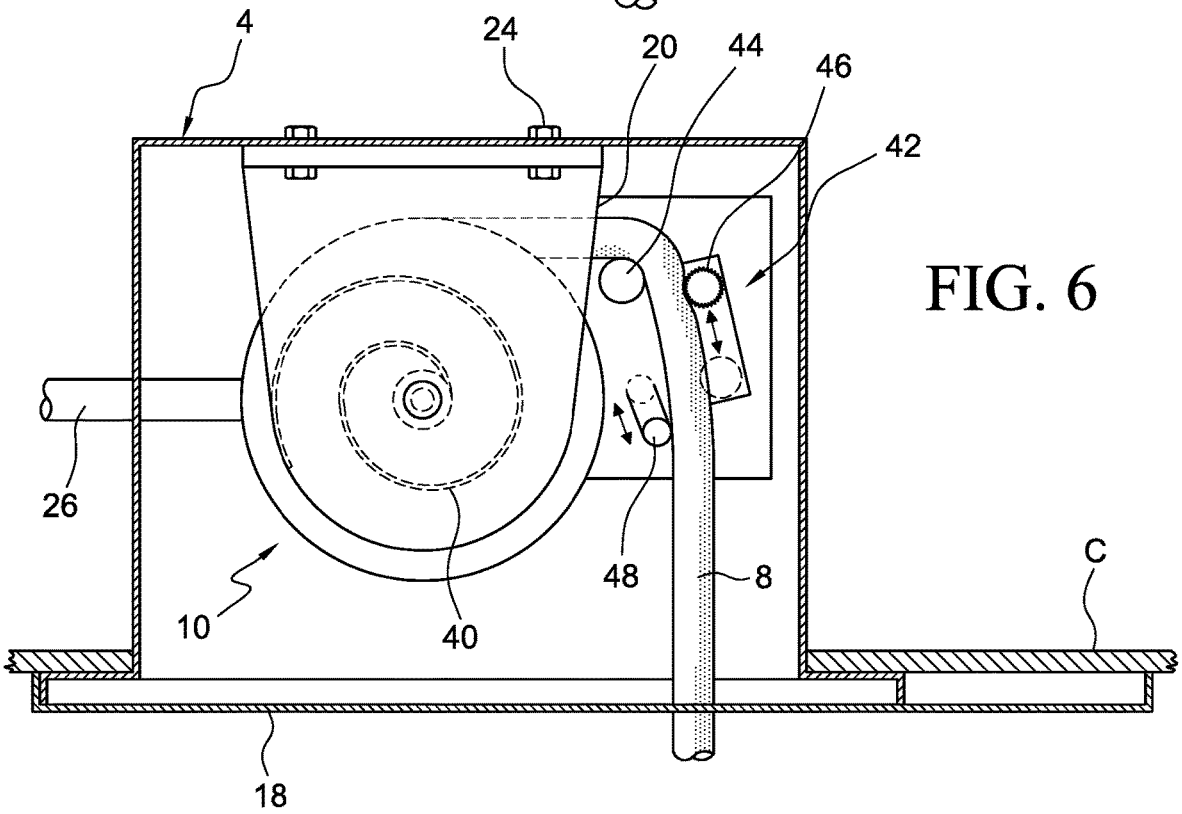
FIG. 6 is a cross-sectional side view of the housing shown in FIG. 2 including a second embodiment of the reel member.

An alternative embodiment for rotating the reel device is shown in FIG. 6. In this embodiment the spool of the reel device 6 is loaded with a spring 40 to generate a counter-clockwise rotational force and the hose 8 is threaded through a cooperating cam wheel locking device 42. The cam wheel locking device 42 is shown to include a conventional shoulder member 44 and cooperating cam wheel 46 to grip the hose and prevent it from being rotationally retracted back onto the spool 10 under the action of the spring. In the locked position the hose 8 may be extended downwardly but it is prevented from retraction due to the locking device 42. A user can pull the hose 8 downwardly to one side which causes release device 48 to be pulled upwards in its slot so that cam wheel 46 is allowed to drop in its slots, disengaging it from the hose. The hose is then free to further extend in a downward direction or to retract in a counter-clockwise direction due to the force generated by spring 40.

It is within the scope of the present invention to provide other means for rotating the reel device 6 to enable the hose to be deployed or retracted. For example, an electric motor or some other automatic drive system may be provided so long as the user can selectively adjust the height of the shower head by either engaging the shower head or operating a separate control device.

Figure 7:
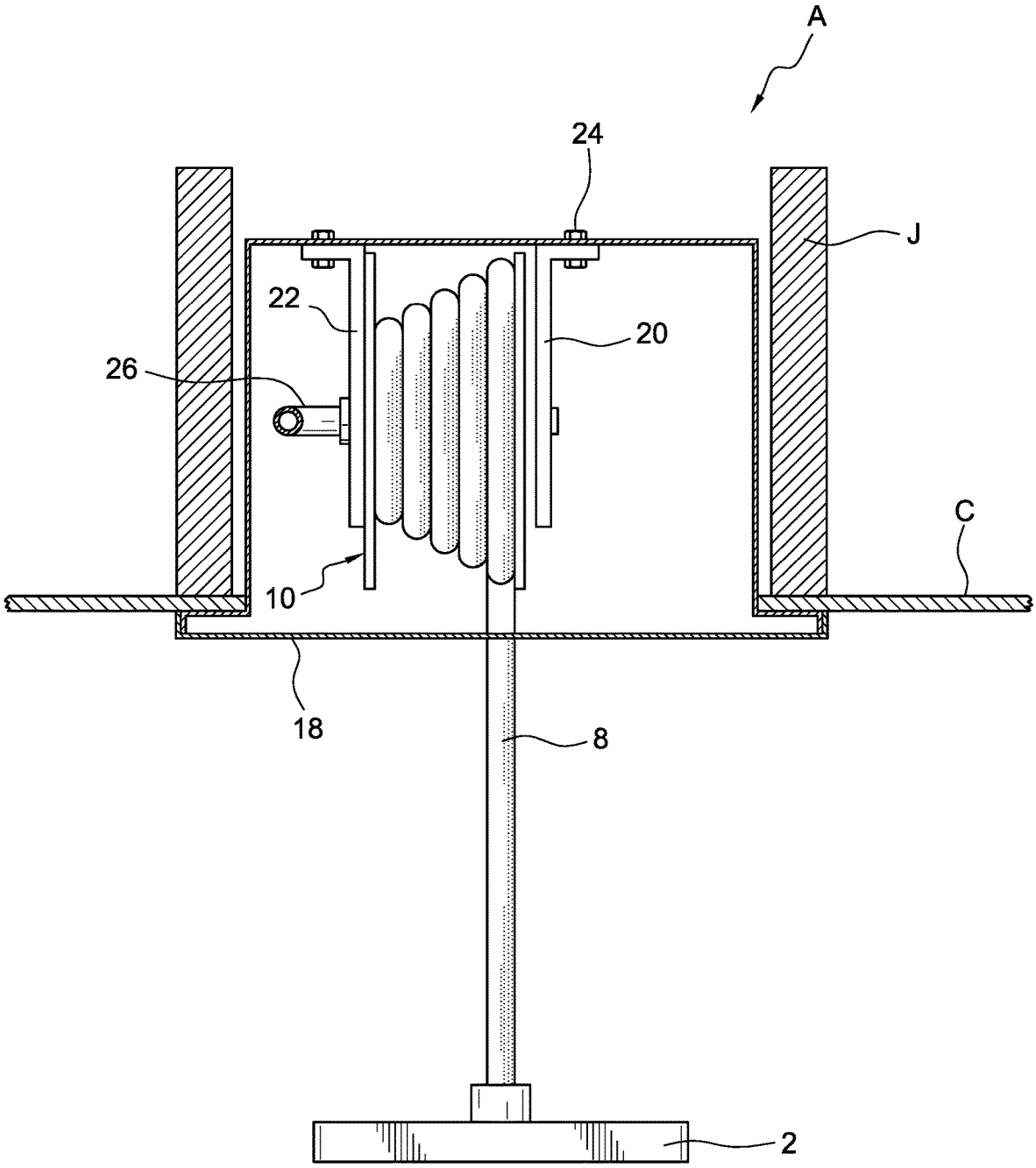
FIG. 7 is a cross-sectional side view of the housing show in in FIG. 2 and showing an alternative embodiment of the reel assembly.

FIG. 7 shows an alternative embodiment of the invention whereby the spool 10 is provided with a taper at a rate that keeps the torque applied to the drum under the action of the constant torque spring (not shown) proportional to the weight of the shower head 2 and the extended hose 8 so that the weight of hose and the shower head are balanced at all distances from the ceiling.

While this invention has been described as having a preferred design, it is understood that it is capable of further modifications, uses and adaptations, both in whole and in part, while following the general principle of the invention and including such departures from the present disclosure as is known or customary practice in the art to which this invention pertains, and as may be applied to the central features of this invention.

I claim:

1. A height adjustable shower head assembly comprising:

a) a housing adapted for mounting to a ceiling, the housing having a top, a bottom and sides;

b) a reel member provided in the housing, the reel member is fixed to the top of the housing;

c) a flexible hose having first end and second ends; and d) the flexible hose is stored on the reel and is adapted to be vertically deployed from the reel and retracted onto the reel, the first end of the flexible hose is connectable to a water supply, the second end of the flexible hose is connectable to a shower head whereby the distance of the connected shower head from the ceiling may be adjusted by selectively deploying or retracting the flexible hose wherein the top and sides of the housing are positioned above the ceiling to which it is mounted and the bottom of the housing is disposed below the ceiling to which it is mounted.

2. The shower head assembly of claim 1 further comprising a shower head, the shower head is connected to the second end of the flexible hose and is disposed exterior of the housing.

3. The shower head assembly of claim 2 and wherein the shower head has a planar surface adapted to mate against the housing when the shower head is fully retracted.

4. The shower head assembly of claim 1 and wherein the housing is adapted to be disposed above a ceiling.

5. The shower head assembly of claim 1 and wherein the reel member includes a spool having a uniform diameter.

6. The shower head assembly claim 1 and wherein the reel member includes a spool having a tapered diameter.

7. The shower head assembly of claim 1 and further including a spring member operationally associated with the reel member for generating a rotational force.

8. The shower head assembly of claim 7 and wherein the reel member further includes a ratchet and pawl mechanism to deploy and retract the hose.

9. The shower head assembly of claim 7 and wherein the reel member further includes a cam wheel locking device to deploy and retract the hose.

* * * * *